United States Patent [19]

Kaminkow

[11] Patent Number: 4,936,580

[45] Date of Patent: Jun. 26, 1990

[54] RETAINER FOR A PINBALL MACHINE

[75] Inventor: Joseph E. Kaminkow, Arlington Heights, Ill.

[73] Assignee: Data East Pinball, Inc., Melrose Park, Ill.

[21] Appl. No.: 419,653

[22] Filed: Oct. 11, 1989

[51] Int. Cl.[5] ..... A63F 7/22; A63F 7/00; E06B 7/28; A47B 88/00

[52] U.S. Cl. ..... 273/121 A; 273/121 R; 248/351; 312/325; 312/327

[58] Field of Search ..... 273/121 A, 121 R; 248/351; 312/251, 314, 315, 317, 325, 327

[56] References Cited

U.S. PATENT DOCUMENTS

| | | | |
|---|---|---|---|
| 2,409,925 | 10/1946 | Bloom | 312/315 |
| 3,401,992 | 9/1968 | Benson et al. | 312/327 |
| 4,429,933 | 2/1984 | Sokolowski | 312/325 |

*Primary Examiner*—Edward M. Coven

*Assistant Examiner*—Gary Jackson

*Attorney, Agent, or Firm*—Gerstman & Ellis, Ltd.

[57] ABSTRACT

A pinball machine defines a play field pivotally carried by a housing to permit pivoting of the play field upwardly to a repair position from a lower, operating position. The housing carries on its lower side a metal bracket defining a downwardly facing base. A retaining aperture is defined in the base of the metal bracket. The support arm is carried by the housing and is pivotable whereby an outer end of the support arm can engage the retaining aperture when the play field is in its repair position, to reliably hold the play field in the repair position. The support arm preferably defines a longitudinally projecting tab of narrower width than the rest of the support arm, the aperture being proportioned to receive the tab while the outer end of the rest of the support arm bears against the base of the bracket when the play field is in the repair position.

7 Claims, 1 Drawing Sheet

Fig. 1
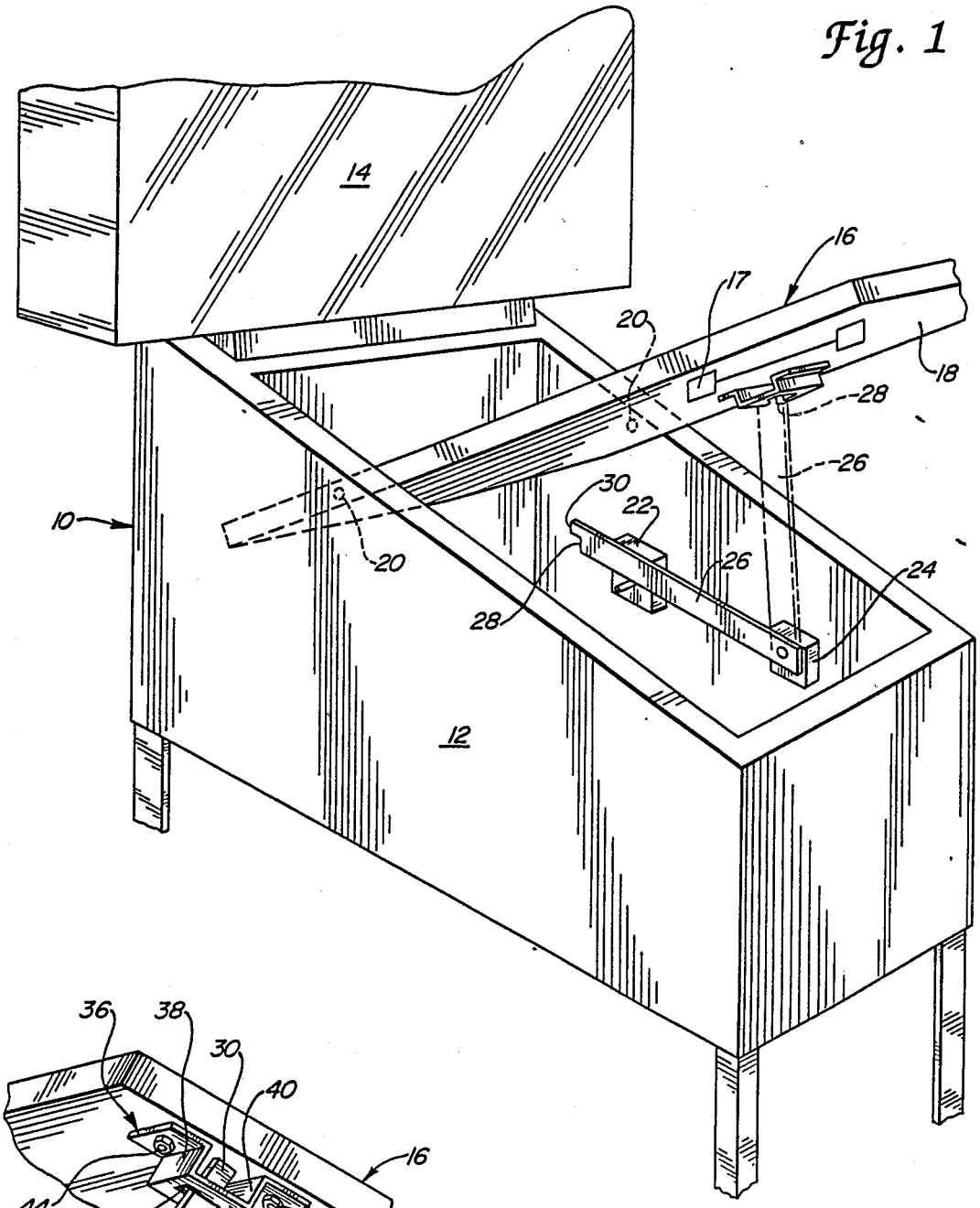
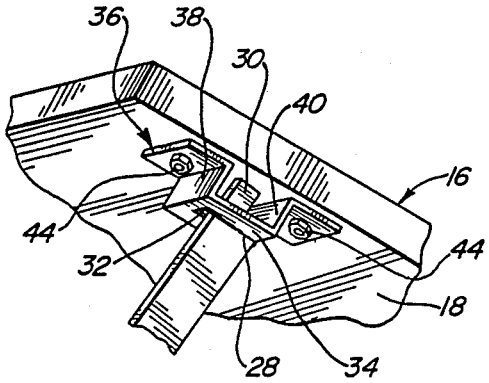
Fig. 2

RETAINER FOR A PINBALL MACHINE

BACKGROUND OF THE INVENTION

Pinball machines are an old, familiar type of entertainment, in which a play field which is carried by a housing, carries, in turn, a series of typically electrically operated targets for a metal ball. A plunger launches the metal ball onto the play field, which usually has a slight slope so that the ball tends to roll forwardly. As various targets are struck, the score is electronically indicated on an upright display.

The electric connections and electronic circuitry are typically carried on the underside of the play field. Accordingly, in many pinball machines, the play field is carried in the housing in pivotable relation, so that it may be pivoted up from the front to expose the lower side to a technician for repair or maintenance. The play field is typically pivoted to the rear so that it is substantially front-heavy. Thus it tends to fall downwardly out of its pivotally upper, repair position unless it is positively held in that pivotally upper position. Such holding is typically provided by a pivoted support arm, having a projection on its end which fits into a depression formed in the play field, which is typically made of a piece of plywood.

However, the play field is rather heavy, so that the depression which is cut into the typically-wooden play field can wear, with the result that the support arm, in prior art pinball machines, can often be easily knocked out of its engagement with the slot in the play field. Also, there is a difficulty in forming a depression in the play field that is deep enough and with sharp enough corners to hold the support arm with high reliability. When the support arm is accidentally disengaged from the depression in the play field undersurface, the play field can fall with a bang, sometimes onto the technician who is bent over the front of the housing working under the play field, with the risk of injury. Additionally, electrical and electronic components carried on the play field can be damaged when the support arm is accidentally disengaged, to let the play field fall downwardly from its repair position to its lower, operating position.

By this invention an improvement is provided in the form of a reliable system for effectively holding the support arm in engaged relation with the upwardly pivoted play field, with greatly reduced risk of accidental disengagement.

DESCRIPTION OF THE INVENTION

In this invention, a pinball machine is provided, which pinball machine may be of a conventional design well-known to those skilled in the art except as otherwise described herein. The pinball machine defines a play field which is pivotally carried by a housing of the pinball machine, to permit pivoting of the play field upwardly to a repair position from a lower, operating position.

The housing carries a pivotally mounted support arm. The play field carries on its lower side a metal bracket defining a downwardly-facing base, and a retaining aperture defined in the base. The support arm is pivotable to permit an outer end of the support arm to engage the retaining aperture when the play field is in its repair position, to reliably hold the play field in the repair position. The retaining aperture may be proportioned to snugly receive the support arm for relatively tight, reliable retention thereof until it is desired to disengage the support arm from its engagement in the retaining aperture, to return the play field to its lower, operating position.

It has been found that this metal bracket provides a simple but non-wearing, reliable aperture connection for the end of the support arm, which provides more reliable protection against inadvertent disengagement and the sudden dropping of the heavy play field toward its lower, operating position. Thus, by this invention, injuries to repair technicians can be avoided, and the pinball machine itself can be protected from damaging shock due to such inadvertent dropping.

The metal bracket preferably defines at least a U-shaped portion comprising the base as described above, plus arms at each end of the base extending toward the play field and secured to the play field at the ends of the arms remote from the base. By this, the base is spaced from the play field, so that an end of the support arm can penetrate the retaining aperture for a desired distance without being stopped by engagement with the underside of the play field.

Preferably, the outer end of the support arm defines a longitudinally projecting tab of narrower width than the rest of the support arm. The retaining aperture is proportioned to receive the tab, while the outer end of the rest of the arm bears against the base of the bracket when the play field is in the repair position. By this means it is possible to provide a very reliable, slip-proof connection between the pivotally mounted support arm and the upwardly pivoted play field, so that accidents resulting from accidental disengagement between the two members can be avoided, even after substantial use where, in the prior art, significant wear takes place in the aperture of the play field, increasing the chances of accidental disengagement.

DESCRIPTION OF THE DRAWINGS

In the drawings,

FIG. 1 is a perspective view of a pinball machine which carries a pivotally elevatable playing field for maintenance and repair purposes, as well as the pivotally mounted support arm and retainer in accordance with this invention; and FIG. 2 is an enlarged, fragmentary side perspective view of a portion of play field in elevated position, showing the engagement of the support arm with the retaining aperture of the metal bracket in accordance with this invention.

DESCRIPTION OF SPECIFIC EMBODIMENT

Referring to the drawings, FIG. 1 illustrates a pinball machine 10 which may be entirely of conventional design and structure except as otherwise described herein.

Pinball machine housing 12 is provided, with the housing carrying a display board 14 of conventional design for pinball machines. Play field 16 is provided, being typically made from a sheet of plywood, carrying the usual electrical targets on its upper side, and electronic microprocessors and electric wires 17 on its underside 18. Play field 16 is attached adjacent its rear end to pivots 20 so that the play field may be pivoted upwardly for access to its underside 18 for maintenance or repair as shown, but also may be pivoted downwardly into a conventional playing position, with the play field resting on side supports 22, 24 in the playing position. Typically in the playing position, the front end of play field 16 slopes downwardly to a small extent to permit the pinballs to tend to roll forwardly toward a ball retrieving member or the like.

Pivoting support arm 26 pivots about play field support 24 between a generally horizontal position and a vertical position as shown in dotted lines, in which vertical position the outer end 28 of support arm 26 engages play field 16 in its upwardly pivoted position, to retain the play field in that position as shown in FIG. 1.

At the outer end 28 of support arm 26 there is defined a longitudinally projecting tab 30, which is typically an integral part of the support arm. As shown in FIG. 2, tab 30 of support arm 26 is shown to be extending through a aperture 32 which is defined in downwardly facing base 34 of metal bracket 36. Metal bracket 36 is shown to define a U-shaped portion comprising base 34 plus arms 38, 40 carried at each end of the base and extending toward the underside 18 of play field 16. Arms 38, 40 each define a side tab which is apertured to permit a screw 44 to pass therethrough for secure retention of metal bracket 36 to the underside of play field 16.

Aperture 32 is proportioned to receive tab 30, as shown in FIG. 2, while the outer end 28 of the rest of arm 26 bears against base 34 of the bracket as arm 26 retains the play field in its pivotally upward, repair position. This facilitates easy insertion of tab 30 into aperture 32, but results in an arrangement in which support arm 26 is very unlikely to become accidentally disengaged from aperture 32.

Since both support arm 26 and bracket 36 are preferably made of steel or another appropriate metal, essentially no wear takes place between arm 26 and bracket 36 despite heavy and frequent use. Thus, unlike the prior art where a pivoting support arm attempts to support an upwardly pivoted play field by engagement with a aperture in the play field itself, the absence of wear and the particular geometry of the relationship of aperture 32, tab 30, and outer end 28 of the rest of support arm 26 provides significant improvements in operation, particularly the substantial elimination of accidental falling of the play field downwardly toward its lower pivoting position, which can result in physical injury to repair technicians and damage to the components of the pinball machine.

Aperture 32 is typically of a length that is at least slightly less than the width of support arm 26, so that the end 28 of support arm 26 cannot pass through the aperture, but only tab 30, so that at least a portion of end 28 will bear against base 34 of bracket 36. Thus the outer end of tab 30 may be spaced from play field 16 even when support arm 26 is engaged therewith, as shown in FIG. 2.

The above has been offered for illustrative purposes only, and is not intended to limit the scope of the invention of this application, which is as defined in the claims below.

That which is claimed is:

1. A pinball machine which defines a play field pivotally carried by a housing to permit pivoting of the play field upwardly to a repair position from a lower, operating position, said housing carrying a pivotally mounted support arm, said play field carrying on its lower side a metal bracket defining a downwardly-facing base, and a retaining aperture defined in said base, said support arm being carried by said housing and pivotable whereby an outer end of said support arm can engage said retaining aperture when the play field is in its repair position, to reliably hold said play field in the repair position.

2. The pinball machine of claim i in which said metal bracket defines at least a U-shaped portion comprising said base plus arms at each end of the base extending toward said play field and secured to said play field at the ends of the arms remote from said base, whereby said base is spaced from the play field.

3. The pinball machine of claim 1 in which said play field is made of wood.

4. The pinball machine of claim 1 in which the outer end of said support arm defines a longitudinally projecting tab of narrower width than the rest of the support arm, said aperture being proportioned to receive said tab while the outer end of the rest of the support arm bears against said base of the bracket when the play field is in the repair position.

5. A pinball machine which defines a play field pivotally carried by a housing to permit pivoting of the play field upwardly to a repair position from a lower, operating position, said housing carrying a pivotally mounted support arm, said play field carrying on its lower side a U-shaped metal bracket defining a downwardly-facing base as part of the U-shape, plus arms at each end of the base extending towards said play field and secured to said play field at the ends of the arms remote from said base, whereby said base is spaced from the play field, said base defining a retaining aperture; a support arm carried by said housing and being pivotable whereby an outer end of said support arm can engage said retaining aperture when the play field is in its repair position, to reliably hold said play field in the repair position, and in which the outer end of said support arm defines a longitudinally projecting tab of narrower width than the rest of the support arm, said aperture being proportioned to receive said tab while the outer end of the rest of the support arm bears against said base of the bracket when the play field is in the pivotally upward repair position.

6. The pinball machine of claim 5 in which said play field is made of wood.

7. The pinball machine of claim 5 in which said play field is supported in its pivotally lower operating position by support members mounted on the housing and positioned forward of the point of pivoting of said play field.

* * * * *